US009273569B2

(12) United States Patent
Seale et al.

(10) Patent No.: US 9,273,569 B2
(45) Date of Patent: Mar. 1, 2016

(54) GAS TURBINE HALF-CASING LIFTING AND SHIPPING FIXTURE

(71) Applicant: General Electric Company, Schenectady, NY (US)

(72) Inventors: Jason Allen Seale, Simpsonville, SC (US); Gregory Allan Crum, Mauldin, SC (US); Netaji Haribhau Mane, Bangalore (IN)

(73) Assignee: General Electric Company, Schenectady, NY (US)

( * ) Notice: Subject to any disclaimer, the term of this patent is extended or adjusted under 35 U.S.C. 154(b) by 560 days.

(21) Appl. No.: 13/736,421

(22) Filed: Jan. 8, 2013

(65) Prior Publication Data

US 2014/0193252 A1 Jul. 10, 2014

(51) Int. Cl.

| | |
|---|---|
| ***F01D 25/26*** | (2006.01) |
| ***F01D 25/28*** | (2006.01) |
| ***F01D 25/24*** | (2006.01) |

(52) U.S. Cl.

CPC ..... *F01D 25/243* (2013.01); *F01D 25/26* (2013.01); *F01D 25/285* (2013.01); *F05D 2260/02* (2013.01)

(58) Field of Classification Search

CPC ..... F01D 25/24; F01D 25/243; F01D 25/28; F01D 25/26; F01D 25/285; F05D 2260/02

USPC ..... 415/213.1, 214.1, 215.1, 220; 29/281.1; 60/796, 797; 410/44, 46, 47, 49, 120; 248/671; 108/55.3

See application file for complete search history.

(56) References Cited

U.S. PATENT DOCUMENTS

| | | | | |
|---|---|---|---|---|
| 3,466,724 | A * | 9/1969 | Morris, Sr. | 29/888.024 |
| 4,362,464 | A * | 12/1982 | Stock | 415/136 |
| 6,334,746 | B1 | 1/2002 | Nguyen et al. | |
| 6,352,404 | B1 * | 3/2002 | Czachor et al. | 415/116 |
| 6,793,458 | B2 | 9/2004 | Kawai et al. | |
| 7,704,024 | B2 | 4/2010 | Kootstra et al. | |
| 8,186,916 | B2 | 5/2012 | Wessel et al. | |
| 8,834,113 | B2 * | 9/2014 | Schaus et al. | 415/209.2 |
| 8,864,459 | B2 * | 10/2014 | Casavant et al. | 415/213.1 |
| 8,876,448 | B1 * | 11/2014 | Hess et al. | 410/46 |
| 8,992,167 | B2 * | 3/2015 | Casavant et al. | 415/173.1 |

OTHER PUBLICATIONS

U.S. Appl. No. 14/012,503, filed Aug. 28, 2013, pending.

* cited by examiner

*Primary Examiner* — Christopher Verdier
(74) *Attorney, Agent, or Firm* — Nixon & Vanderhye P.C.

(57) ABSTRACT

A lifting fixture assembly adapted for shipping and/or lifting includes a lower turbine casing having two horizontal joint flanges adapted to engage mating flanges on an upper-turbine casing. The horizontal joint flanges are provided with plural bolt holes used for securing the upper turbine casing to the lower turbine casing. A plurality of cross-beams extend transversely across the lower turbine casing, removably secured to said horizontal joint flanges, using selected ones of the existing bolt holes.

19 Claims, 6 Drawing Sheets

GAS TURBINE HALF-CASING LIFTING AND SHIPPING FIXTURE

BACKGROUND OF THE INVENTION

This invention relates generally to turbine technology and, more specifically, to the manner in which a substantially fully-assembled, lower half-casing of a gas turbine can be shipped to and/or lifted into or out of position at its ultimate site of operation.

There are any number of problems associated with shipping and installing turbomachinery. In the case of gas turbines which are of particular interest here, many power plants do not have the crane capacity to lift a substantially fully-assembled gas turbine lower casing in the event an existing turbine needs to be replaced. In addition, many potential power plant sites do not have transport lanes (railroads or roads) that can support the weight of a substantially fully-assembled gas turbine, nor the cranes needed to lift a substantially fully-assembled gas turbine into position.

Currently, some power plant customers completely disassemble a gas turbine in order to replace an existing gas turbine. More specifically, after the upper casing is removed, the rotor must be removed from the lower casing, followed by removal of the compressor, combustor, and turbine stage components. The disassembly and subsequent reassembly process is time consuming and requires a costly realignment of the upper and lower casings at the site. The reassembly and alignment can take four weeks or longer in some circumstances.

For those sites that may not have the necessary roads, rails, etc. to accommodate a substantially fully-assembled turbine, nor the crane size and lifting capacity, it remains that fully- or partially-assembled turbines simply cannot be delivered to those locations.

It would therefore be desirable to provide a mechanism by which a substantially assembled lower-half casing of a gas turbine can shipped and/or lifted into (or out of) its operating position without requiring disassembly or subsequent realignment of the lower half casings.

BRIEF SUMMARY OF THE INVENTION

In a first exemplary but nonlimiting embodiment, there is provided a lifting fixture and lower turbine casing assembly adapted for shipping and/or lifting the lower turbine casing comprising a lower turbine casing having two horizontal joint flanges adapted to engage mating flanges on an upper-turbine casing, the horizontal joint flanges provided with plural bolt holes used for securing the upper turbine casing to the lower turbine casing; and a plurality of cross-beams extending transversely across the lower turbine casing, removably secured to the horizontal joint flanges, using selected ones of the plural bolt holes.

In another nonlimiting aspect, there is provided a lifting fixture and lower turbine casing assembly for a lower turbine casing substantially fully assembled except for a turbine rotor, the lower turbine casing formed with horizontal joint flange extending along opposite sides thereof; the horizontal joint flanges formed with plural bolt holes for bolting the lower turbine casing to an upper turbine casing; the assembly comprising a first plurality of I-beams extending across the lower turbine casing and fastened to the lower turbine casing by bolts extending through selected ones of the plural bolt holes in the horizontal joint flanges, each of the I-beams comprising a web and flanges at opposite ends of the web; and a second plurality of outer, generally axially-oriented I-beams attached to each of the first plurality of I-beams and located along the horizontal joint flanges.

In still another aspect, the present invention provides a lifting fixture and lower turbine casing assembly adapted for shipping and/or lifting the lower turbine casing comprising a lower turbine casing having two horizontal joint flanges adapted to engage one or more mating flanges on an upper-turbine casing, the horizontal joint flanges provided with plural bolt holes used for securing the upper turbine casing to the lower turbine casing; a plurality of cross-beams extending transversely across the lower turbine casing, removably secured to the two horizontal joint flanges, using certain of the plural bolt holes; outer beams extending along the horizontal joint flanges generally in an axial direction and secured to each of the plurality of cross-beams; and at least one axially-extending beam between the outer beams and secured to each of the cross-beams.

The invention will now be described in greater detail in connection with the drawings identified below.

DETAILED DESCRIPTION OF THE INVENTION

Figure 1:
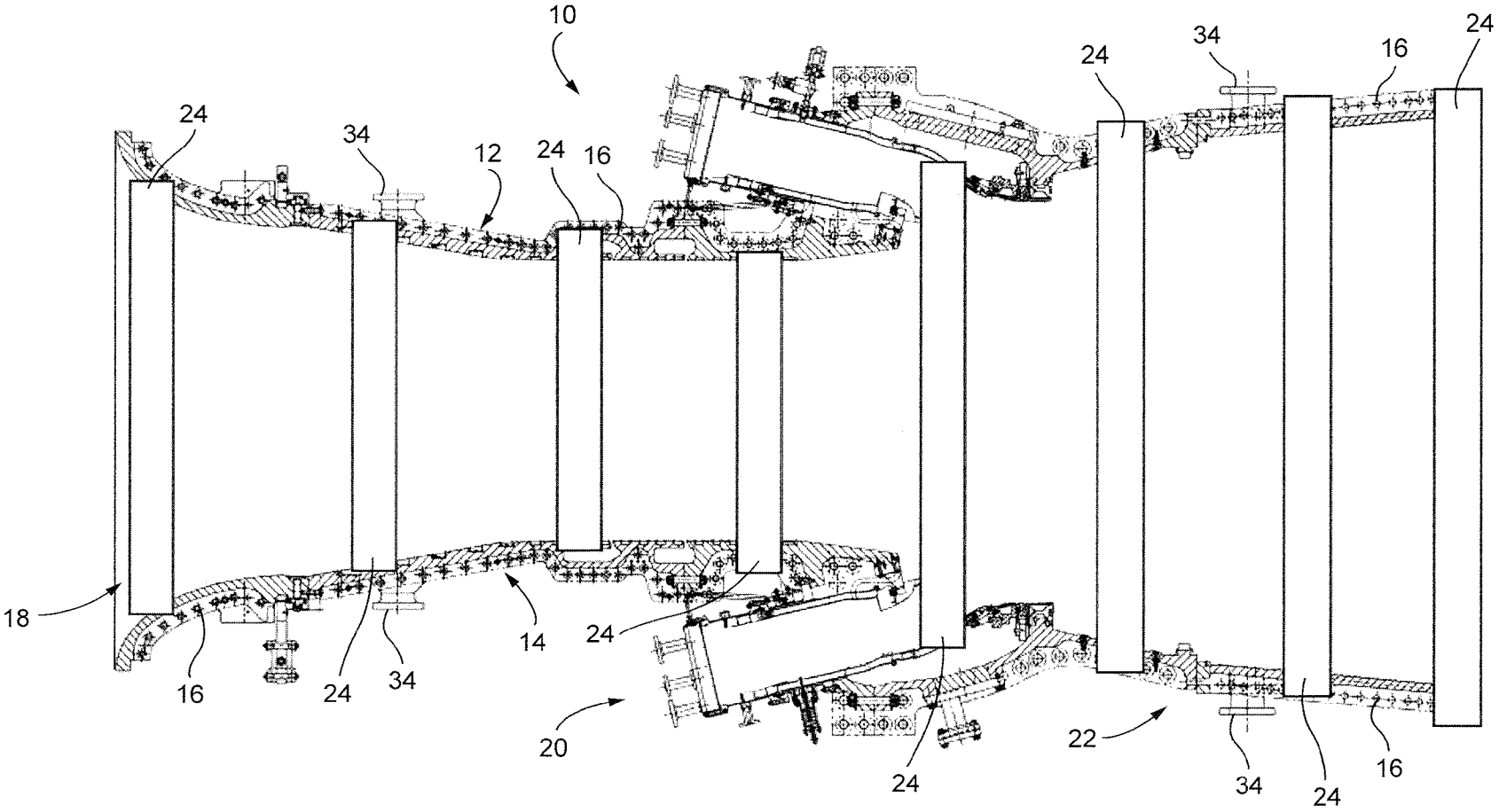
FIG. 1 is a partial plan view of a lower-half gas turbine casing with a lifting and shipping fixture frame in accordance with a first exemplary but nonlimiting embodiment of the invention.

FIG. 1 illustrates a lower-turbine casing or shell 10 provided with horizontal joint flanges 12 and 14 extending along opposite sides of the casing. As can be seen from the illustration, the joint flanges 12 and 14 each define an irregular, outer joining surface comprised of several sections, but for convenience, the collective sections will be referred to herein simply as joint flanges, one on each of the opposite sides of the casing.

At various positions along the joint flanges 12, 14, there are bolt holes 16 that enable the lower turbine casing to be joined to an upper turbine casing (not shown) after the turbine rotor has been installed in the lower turbine casing.

The invention here is concerned with shipping and/or lifting of the lower turbine casing and/or lifting of the lower turbine casing in a substantially fully-casing-assembled state, i.e., with various components of the compressor 18, combustor 20 and turbine stages 22 assembled within the lower casing. In other words, the only major component not installed in the lower turbine casing is the rotor assembly (not shown). In order to enable the shipping and/or lifting of the lower turbine casing 10 as described, the casing must be stiffened to prevent excess bending stresses, and to maintain all clearances so that no realignment of components is required upon installation of the rotor assembly and upper turbine casing.

In the first exemplary but nonlimiting embodiment shown in FIG. 1, a shipping/lifting fixture assembly includes, a plurality of cross-beams 24 are secured to the lower turbine casing 10, and specifically to the horizontal joint flanges 12, 14. The cross-beams, preferably in the form of I-beams each having a web 26 and upper and lower flanges 28, 30 (see FIG. 2), extend transversely across the casing 10, with opposite ends of the cross-beams 24 secured to the horizontal joint flanges 12 and 14 using selected ones of existing the existing bolt holes 16.

The identification of those bolt holes 16 to be used with the cross-beams 24 is done by analyzing stresses on the lower turbine casing 10 via computer modeling, and using threshold stresses and deflections as the key to locating the cross-beams 24 to provide the required stiffness. The lateral and axial beams are designed by evaluating the stresses and deflections encountered during lifting and/or shipping of the assembled lower half of the turbine with the fixture installed. Finite Element Analysis (FEA) software is used to analyze the stresses and deflections in an iterative process. The first step in the analysis is to evaluate the stresses and deflections of the assembled lower half casings under the shipping and/or lifting forces without the frame installed. The next step is to place beams of a standard, commonly available size, in locations that will oppose any deflections or stresses that exceed design limits. The analysis is repeated to determine if the fixture design produces stresses and deflections within the design limits. If stresses or deflections exceed the design limits, beams are resized, added, removed, or moved based on the FEA results. This process is repeated until the lower half casings and lifting fixture meets design limits for stresses and deflections.

Figure 2:
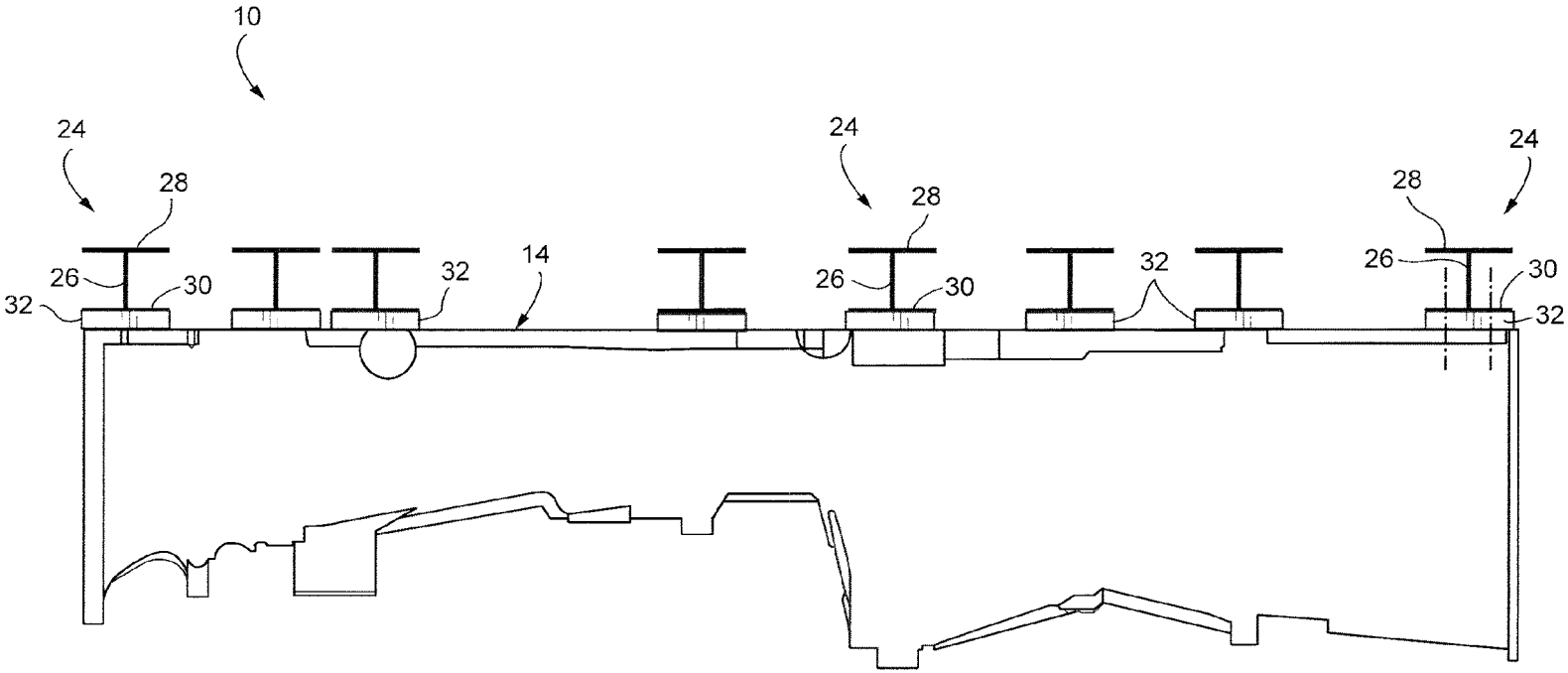
FIG. 2 is a side elevation of the lower-half casing and shipping fixture shown in FIG. 1.

FIG. 2 also illustrates the use of pads 32 between cross-beams 24 and the joint flanges 12, 14. The pads 32 are provided with bolt holes (not shown) that align with bolt holes in the lower flange 30 of the beam 24 which, in turn, are aligned with the selected bolt holes 16 in the joint flanges 12, 14. This bolting arrangement is diagrammatically illustrated in FIG. 2 at the cross-beam 24 to the far right of the casing. Pads 32 are attached to the underside of beams 24 by welding or bolting prior to fixation of the cross-beams 24 to the lower casing 10.

Note that in any shipping and/or lifting operation, the lower turbine casing 10 is not lifted at the cross-beams 24. Rather, conventional lifting "eyes" or other devices 34 are attached directly to the casing 10 (typically at four locations as shown in FIG. 1) and are designed to receive lifting cables (not shown).

Figure 3:
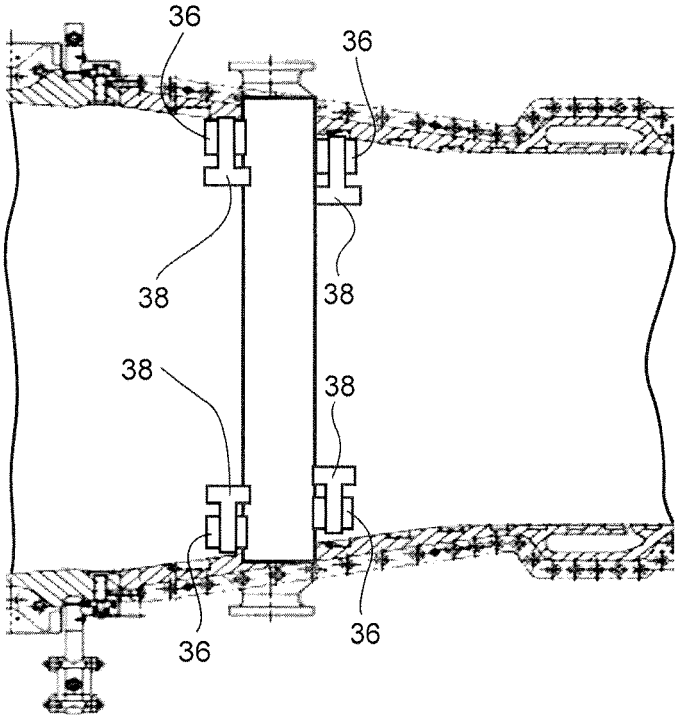
FIG. 3 is a partial plan view of a lateral-support mechanism for use with the shipping fixture design shown in FIGS. 1 and 2.
Figure 4:
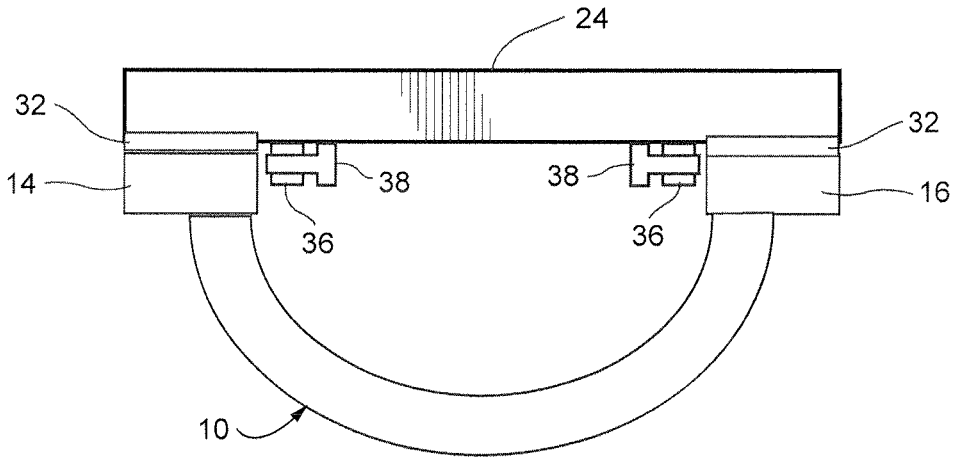
FIG. 4 is a side elevation of the lateral-support mechanism shown in FIG. 6.

In order to prevent any unwanted shifting of the cross-beams 24 in an axial direction, additional lateral support mechanisms may be provided at opposite ends of each cross-beam as best seen in FIGS. 3 and 4. Specifically, one or two blocks 36 (depending on horizontal joint shape) may be welded to the underside of the beams 24 (i.e., to the underside of flanges 30), extending axially so as to span the width of the cross-beam and to provide sufficient space for a pair of set screws 38 or the like to extend through the blocks in a direction parallel to the cross-beams 24 so as to engage the lower turbine casing joint flanges 14, 16. Tightening the set screws 38 against the casing flanges 14, 16 provides additional lateral stability and inhibits any axial shifting movement of the cross-beams 24.

Figure 5:
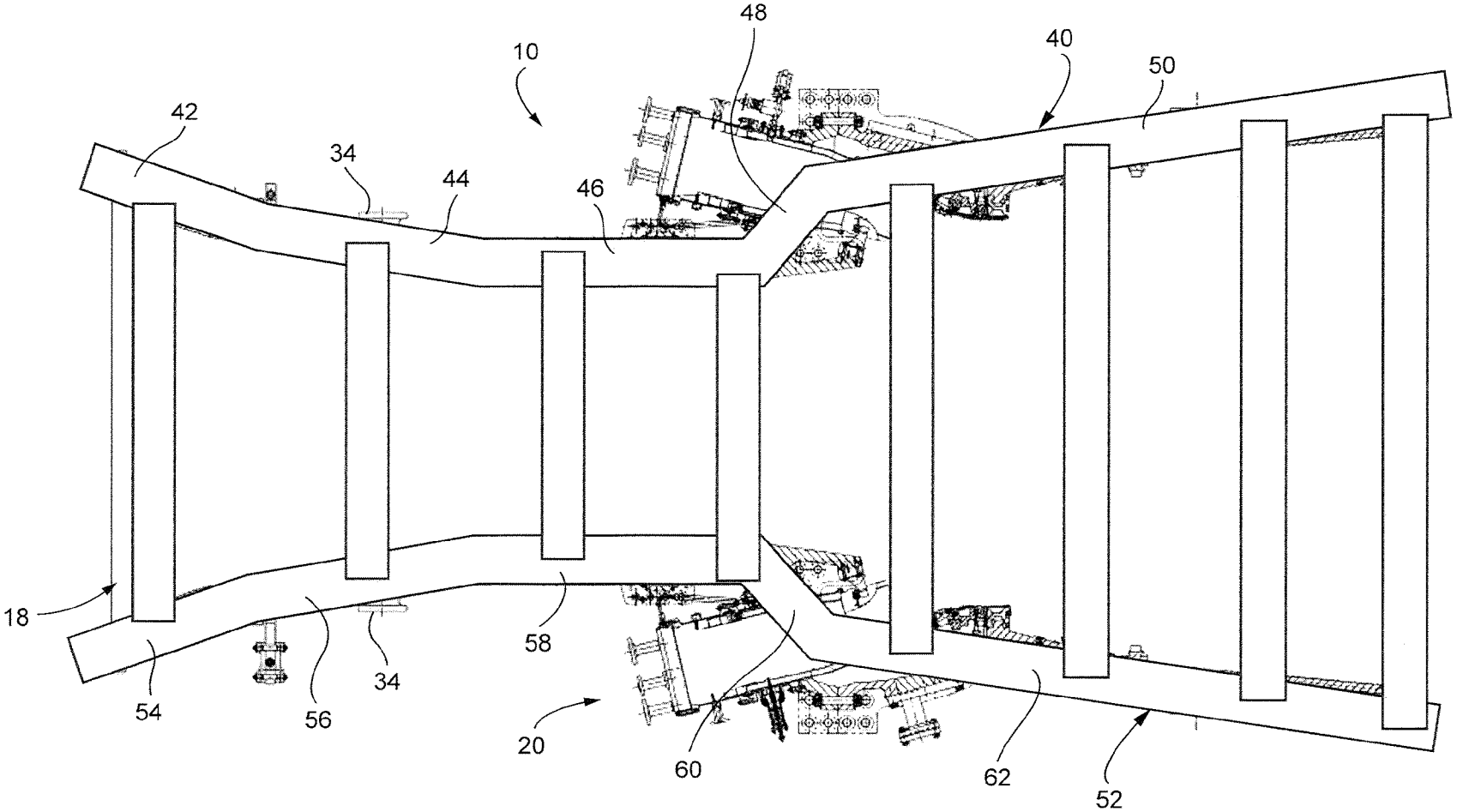
FIG. 5 is a partial plan view of a lower-half casing with a lifting and shipping fixture in accordance with a second exemplary but nonlimiting embodiment.
Figure 6:
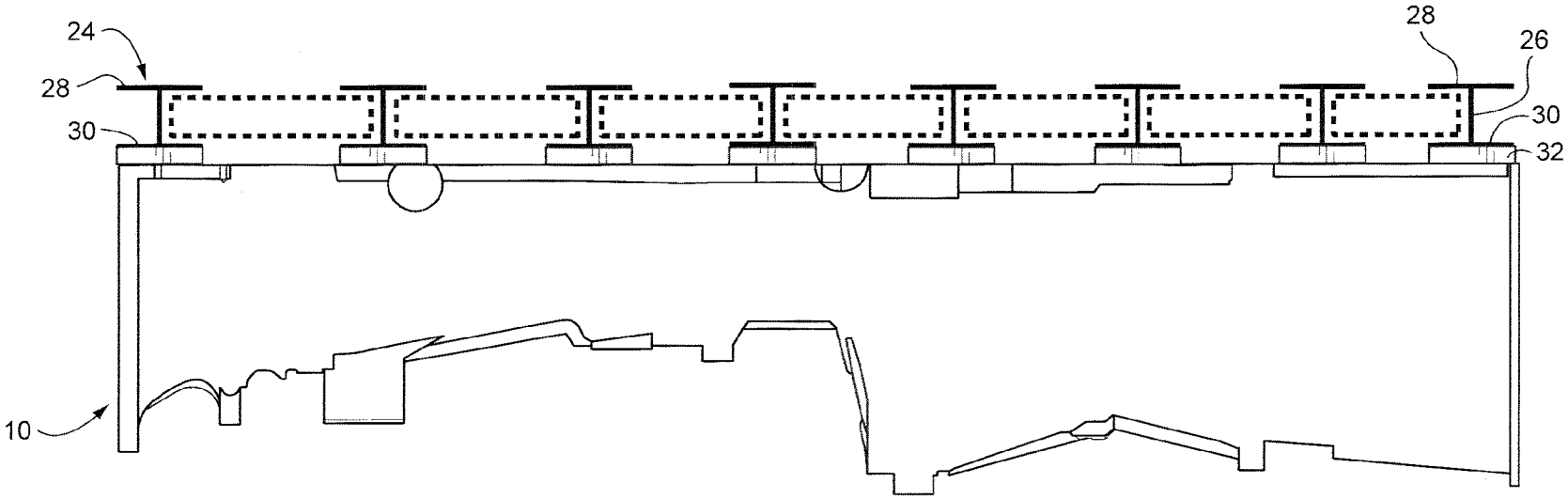
FIG. 6 is a side elevation of the lower-half casing and shipping fixture design shown in FIGS. 5 and 7 (FIG. 6 can also represent FIG. 7)

FIGS. 5 and 6 illustrate a second exemplary but nonlimiting embodiment of the invention. Here, all of the components described in connection with FIGS. 1-4 remain, and similar reference numerals are used to designate corresponding components. Note that while the lateral stability components 36, 38 are not shown in FIGS. 5 and 6, they may be utilized here as well. In addition, generally axially-extending beams 40 and 52 are added to further stiffen the lower turbine casing 10. Specifically, along the horizontal joint flange 12, beam 40 is joined to the lateral cross-beams 24 in a configuration that follows the shape of the joint flange 12. In one arrangement, axial beam sections 42, 44, 46, 48 and 50 may be welded together, and then welded as an assembly to the upper flanges 28 of the beams 24. Alternatively, the beam sections 42, 44, 46, 48 and 50 may be individually welded (or bolted) within (or between) the upper and lower flanges 28, 30 of the respective cross-beams 24 as shown in FIG. 6.

A similar arrangement with axial-beam sections 54, 56, 58, 60 and 62 in a one-piece welded assembly or in individual, discrete sections as described above are provided along the joint flange 14.

Figure 7:
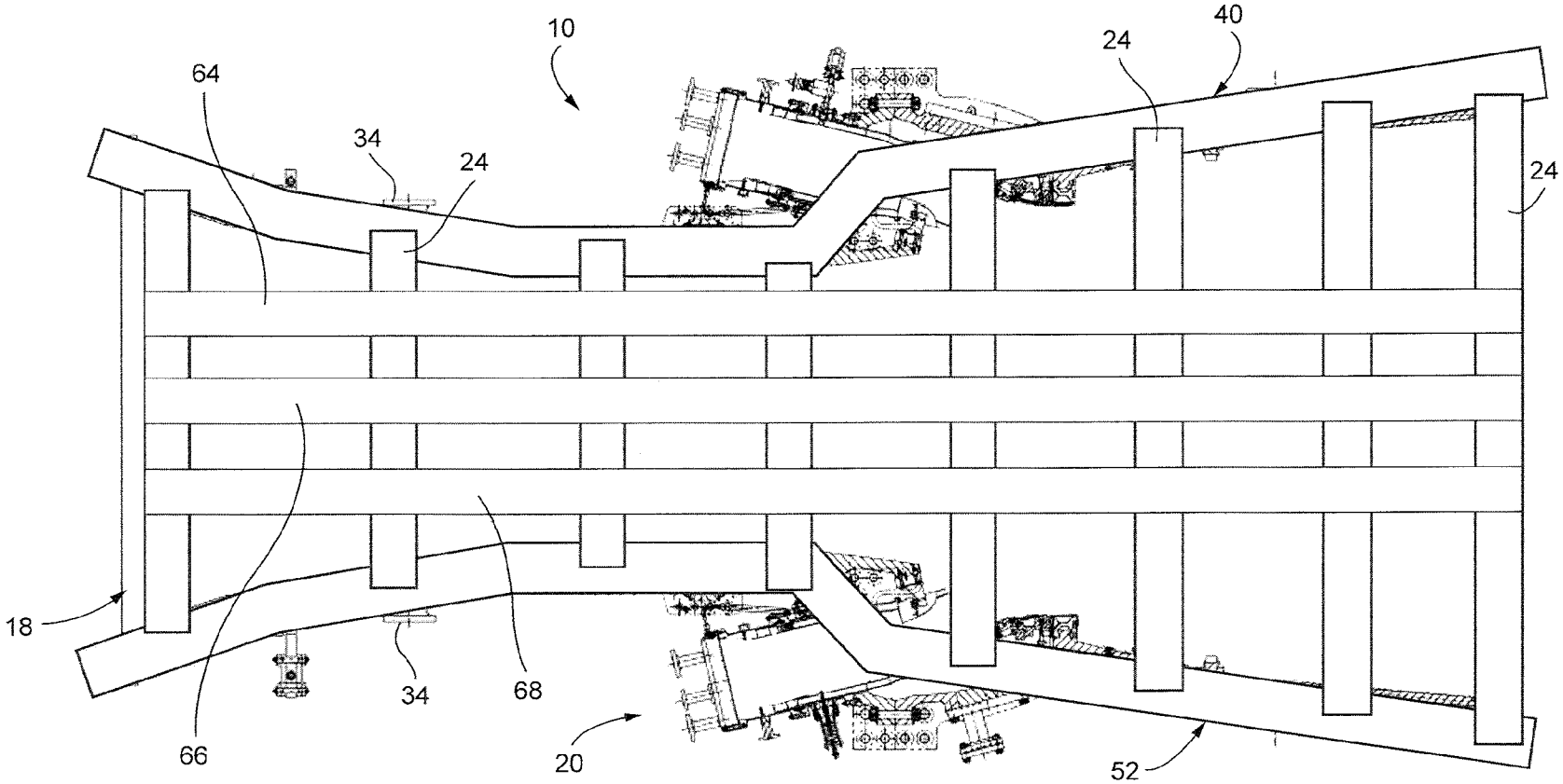
FIG. 7 is a partial plan view of a gas turbine lower half casing with a shipping fixture in accordance with a third exemplary but nonlimiting embodiment of the invention.

In a third exemplary but nonlimiting embodiment shown in FIG. 7, all of the stiffening components used in FIGS. 5 and 6 are retained and, again, the same reference numerals are used to designate corresponding components. In this third exemplary embodiment, a plurality of axially-oriented beams 64, 66 and 68 are attached to the lateral cross-beams 24 at a location "inside" the horizontal joint flanges 12 and 14. These additional beams 64, 66 and 68 may each be of one-piece construction and welded (or bolted) to the upper flanges 28 of the cross-beams 24, or alternatively, may be provided in discrete sections that are welded (or bolted) between upper and lower flanges 28, 30 of each adjacent pair of cross-beams 24. While three additional axially-oriented beams are shown, the number of additional beams may vary depending on the required degree of stiffness and/or the need for redundancy (for safety).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims. Note that while the claims refer to a lifting fixture assembly, that term is regarded as also encompassing a shipping fixture assembly, particularly since shipping of a lower casing typically also involves lifting the assembly. The beneficial stiffening of the lower casing applies, of course, to both lifting and shipping.

What is claimed is:

1. A lifting fixture and lower turbine casing assembly comprising:

a lower turbine casing including horizontal joint flanges configured to engage mating flanges on an upper-turbine casing, the horizontal joint flanges provided with bolt holes configured to secure the upper turbine casing to the lower turbine casing; and cross-beams extending transversely across the lower turbine casing, wherein the cross-beams are removably secured to the horizontal joint flanges using selected ones of the bolt holes, wherein said cross-beams comprise I-beams.

2. The lifting fixture and lower turbine casing assembly of claim 1 wherein mounting pads are secured to an underside of said cross-beams at opposite ends thereof for engagement with said horizontal joint flanges.

3. The lifting fixture and lower turbine casing assembly of claim 1 wherein said plurality of cross-beams are bolted to said horizontal joint flanges.

4. The lifting fixture and lower turbine casing assembly of claim 3 wherein pads are interposed between said cross-beams and said horizontal joint flanges such that bolts pass through said cross-beams, said pads and said horizontal joint flanges.

5. The lifting fixture and lower turbine casing assembly of claim 1 and further comprising outer, generally axially-oriented beams extending along said horizontal joint flanges and secured to said cross-beams.

6. The lifting fixture and lower turbine casing assembly of claim 5 and further comprising at least one axially-extending beam between said outer beams and secured to each of said cross-beams.

7. The lifting fixture and lower turbine casing assembly of claim 6 wherein securements between said cross-beams, said outer-beams and said axially-extending beams are effected by welding or by bolts.

8. The lifting fixture and lower turbine casing assembly of claim 1 wherein each of said I-beams comprises a web and a pair of flanges at opposite ends of said web, and wherein an outer beam extends along each of said horizontal joint flanges generally in an axial direction, and wherein each of said outer beams is provided in discrete sections interfitted with said flanges of said I-beams.

9. A lifting fixture and lower turbine casing assembly of comprising:

a lower turbine casing having two horizontal joint flanges adapted to engage mating flanges on an upper-turbine casing, said horizontal joint flanges provided with plural bolt holes used for securing the upper turbine casing to said lower turbine casing; a plurality of cross-beams extending transversely across the lower turbine casing, removably secured to said horizontal joint flanges, using selected ones of said plural bolt holes, and at least one block attached to opposite ends of each cross-beam adjacent a respective one of said bolt holes, a set screw extending through said at least one block on one side of said cross-beam and adapted to engage one of said horizontal joint flanges.

10. The lifting fixture and lower turbine casing assembly of claim 9 wherein said at least one block spans said cross-beam and wherein a second set screw extends through said block on the other side of said cross beam.

11. A lifting fixture and lower turbine casing assembly adapted for lifting and/or shipping a lower turbine casing substantially fully assembled except for a turbine rotor, the lower turbine casing formed with horizontal joint flanges extending along opposite sides thereof; said horizontal joint flanges formed with plural bolt holes for bolting the lower turbine casing to an upper turbine casing; the assembly comprising:

a first plurality of I-beams extending across said lower turbine casing and fastened to said lower turbine casing by bolts extending through selected ones of said plural bolt holes in said horizontal joint flanges, each of said I-beams comprising a web and flanges at opposite ends of said web; and a second plurality of outer, generally axially-oriented I-beams attached to each of said first plurality of I-beams and located along said horizontal joint flanges.

12. The lifting fixture assembly of claim 11 wherein mounting pads are secured to an underside of said first plurality of I-beams at opposite ends thereof for engagement with said horizontal joint flanges.

13. The lifting fixture assembly of claim 12 wherein bolts pass through one of said flanges of said each I-beam, said mounting pads, and said horizontal joint flanges.

14. The lifting fixture assembly of claim 11 wherein said second plurality of outer, generally axially-oriented I-beams are provided in discrete sections interfitted between flanges of each of said first plurality of I-beams.

15. A lifting fixture and lower turbine casing assembly comprising:

a lower turbine casing including two horizontal joint flanges adapted to engage one or more mating flanges on an upper-turbine casing, the horizontal joint flanges provided with bolt holes configured to secure the upper turbine casing to the lower turbine casing;

cross-beams extending transversely across the lower turbine casing, removably secured to said two horizontal joint flanges, using one or more of the bolt holes;

outer beams extending along the horizontal joint flanges generally in an axial direction and secured to each of the cross-beams; and at least one axially-extending beam between the outer beams and secured to each of the cross-beams.

16. The lifting fixture and lower turbine casing assembly of claim 15 wherein securements between said cross-beams, said outer-beams and said at least one axially-extending beam are effected by welding or by bolts.

17. The lifting fixture and lower turbine casing assembly of claim 15 wherein mounting pads are secured to an underside of said cross-beams at opposite ends thereof for engagement with said horizontal joint flanges.

18. The lifting fixture and lower turbine casing assembly of claim 15 and further comprising at least one block attached to opposite ends of each cross-beam adjacent a respective one of said bolt holes, a first set screw extending through said at least one block on one side of each of said cross-beams and adapted to engage one of said horizontal joint flanges.

19. The lifting fixture and lower turbine casing assembly of claim 18 wherein said at least one block spans said cross-beam and wherein a second set screw extends through said block on the other side of said cross beam.

* * * * *

UNITED STATES PATENT AND TRADEMARK OFFICE

CERTIFICATE OF CORRECTION

PATENT NO. : 9,273,569 B2
APPLICATION NO. : 13/736421
DATED : March 1, 2016
INVENTOR(S) : Jason Allen Seale et al.

It is certified that error appears in the above-identified patent and that said Letters Patent is hereby corrected as shown below:

In the Claims:

In claim 1 at column 4, line 59, change “the upper turbine casing” to --the upper-turbine casing--

In claim 9 at column 5, line 30, change “assembly of” to --assembly--

In claim 11 at column 5, line 49, change “lifting fixture and lower turbine casing assembly” to --lifting fixture assembly--

Signed and Sealed this
Third Day of May, 2016

Michelle K. Lee

Michelle K. Lee
*Director of the United States Patent and Trademark Office*